US011519373B2

(12) United States Patent
Stach et al.

(10) Patent No.: US 11,519,373 B2
(45) Date of Patent: Dec. 6, 2022

(54) METHOD FOR PRODUCING AN INJECTOR

(71) Applicant: Robert Bosch GmbH, Stuttgart (DE)

(72) Inventors: Thomas Stach, Northville, MI (US); James Doetsch, Farmington Hills, MI (US); Jan Tremel, Erlangen (DE); Markus Feigl, Markgroeningen (DE); Peter Rueck, Merkendorf (DE); Roman Poltoratski, Stuttgart (DE); Timo Dehm, Eriskirch (DE)

(73) Assignee: Robert Bosch GmbH, Stuttgart (DE)

( * ) Notice: Subject to any disclaimer, the term of this patent is extended or adjusted under 35 U.S.C. 154(b) by 365 days.

(21) Appl. No.: 16/288,899

(22) Filed: Feb. 28, 2019

(65) Prior Publication Data

US 2019/0271287 A1 Sep. 5, 2019

(30) Foreign Application Priority Data

Mar. 1, 2018 (DE) ..... 102018203065.0

(51) Int. Cl.
*F02M 61/14* (2006.01)
*F02M 69/04* (2006.01)

(52) U.S. Cl.
CPC ..... *F02M 61/14* (2013.01); *F02M 69/044* (2013.01); *F02M 2200/85* (2013.01)

(58) Field of Classification Search
CPC .. F02M 61/14; F02M 69/044; F02M 2200/85; F02M 61/1806; F02M 61/1853; C25D 1/003; C25D 1/08
USPC ..... 123/445
See application file for complete search history.

(56) References Cited

U.S. PATENT DOCUMENTS 4,772,540 A * 9/1988 Deutsch ..... C25D 1/08 430/394
4,995,949 A * 2/1991 Rhoades ..... B23H 9/02 216/84
5,026,462 A * 6/1991 Butterfield ..... F02M 61/168 205/672
5,034,106 A * 7/1991 Nyberg ..... B23H 9/16 205/665
5,127,156 A * 7/1992 Yokoyama ..... F02M 61/168 29/523
5,564,392 A * 10/1996 Oguma ..... F02M 51/0671 123/472
5,766,441 A * 6/1998 Arndt ..... F02M 61/168 205/183

(Continued)

*Primary Examiner* — Logan M Kraft
*Assistant Examiner* — John D Bailey
(74) *Attorney, Agent, or Firm* — Norton Rose Fulbright US LLP; Gerard Messina

(57) ABSTRACT

A method for producing an injector which is designed in particular to inject fuel into an induction pipe or directly into a combustion chamber of an internal combustion engine. The method includes providing an injector base element, providing a rod that is insertible into a through hole of the injector base element, producing a negative matrix of a spray orifice element on an axial end of the rod, inserting the rod into the through hole of the injector base element, positioning the negative matrix situated on the rod relative to the injector base element, producing the spray orifice element having at least one spray orifice by applying a galvanization layer on a downstream end, in the injection direction, of the injector base element and on the negative matrix, and removing the rod and the negative matrix.

16 Claims, 3 Drawing Sheets

(56) References Cited

U.S. PATENT DOCUMENTS 5,899,390 A * 5/1999 Arndt ..... B05B 1/34 239/596
5,924,634 A * 7/1999 Arndt ..... B41J 2/1631 239/596
6,027,049 A * 2/2000 Stier ..... F02M 51/0667 239/585.1
6,050,507 A * 4/2000 Holzgrefe ..... F02M 61/184 239/596
6,103,399 A * 8/2000 Smela ..... B81C 1/00952 428/614
6,116,863 A * 9/2000 Ahn ..... F04B 43/14 417/322
6,161,782 A * 12/2000 Heinbuck ..... B05B 1/3426 239/491
6,170,764 B1 * 1/2001 Muller ..... F02M 61/162 239/584
6,230,992 B1 * 5/2001 Arndt ..... B05B 7/0892 239/596
6,235,177 B1 * 5/2001 Borland ..... B41J 2/1433 205/67
6,273,349 B1 * 8/2001 Fischbach ..... F02M 51/0671 239/596
6,280,832 B1 * 8/2001 Heyse ..... C25D 1/08 428/209
6,434,826 B1 * 8/2002 Kubach ..... F02M 61/1853 264/249
6,695,229 B1 * 2/2004 Heinbuch ..... F02M 61/1853 239/584
10,054,094 B2 * 8/2018 Carpenter ..... C25D 1/08
2001/0048035 A1 * 12/2001 Dantes ..... F02M 61/162 239/596
2002/0157956 A1 * 10/2002 Ikeda ..... C25D 1/08 205/75
2002/0179740 A1 * 12/2002 Dantes ..... F02M 61/186 239/585.4
2003/0116650 A1 * 6/2003 Dantes ..... F02M 61/1806 239/483
2003/0121998 A1 * 7/2003 Maier ..... F02M 61/162 239/585.1
2004/0026373 A1 * 2/2004 Dantes ..... F02M 61/166 216/84
2004/0028875 A1 * 2/2004 Van Rijn ..... B01L 3/5085 264/299
2005/0147839 A1 * 7/2005 Suwa ..... H01L 23/488 257/E23.102
2006/0213369 A1 * 9/2006 Edlund ..... B01D 63/06 96/4
2007/0117367 A1 * 5/2007 Shyn ..... B41J 2/14129 438/597
2010/0251997 A1 * 10/2010 Fujino ..... F02M 47/027 29/890.132
2011/0095490 A1 * 4/2011 Qi ..... F02M 61/166 427/407.1
2011/0139121 A1 * 6/2011 Hackenberg ..... F02M 61/1853 123/445
2015/0211462 A1 * 7/2015 Schnobrich ..... F02M 61/1853 239/561
2015/0369192 A1 * 12/2015 Ge ..... F02M 45/086 239/584
2017/0089313 A1 * 3/2017 Noguchi ..... F02M 51/08
2020/0086434 A1 * 3/2020 Carpenter ..... C25D 1/10

* cited by examiner

METHOD FOR PRODUCING AN INJECTOR

CROSS REFERENCE

The present application claims the benefit under 35 U.S.C. § 119 of German Patent Application No. DE 102018203065.0 filed on Mar. 1, 2018, which is expressly incorporated herein by reference in its entirety.

FIELD

The present invention relates to a method for producing an injector, which injects in particular fuel into an induction pipe or directly into a combustion chamber of an internal combustion engine, and to an injector of this kind.

BACKGROUND INFORMATION

Injectors for internal combustion engines are available in the related art in various embodiments. Conventionally, spray orifices are provided on injector outlets for injecting and dispersing the fuel. Normally, such spray orifices are produced by laser drilling. In a laser drilling process, however, a precise positioning and design of the spray orifices is possible only to a limited extent. This process, for example, limits the form design essentially to cylindrical spray orifices. Small inaccuracies in the production of the spray orifices may already result in deviations from the optimal spray patterns for the internal combustion engine. Consequently, there may be an increase in the production of pollutants, in particular an increased particle formation, and a reduction in the efficiency as a result of a deteriorated combustion in the internal combustion engine.

SUMMARY

An example method of the present invention for producing an injector may have the advantage of achieving a high accuracy in the production of an injector in a simple and efficient manner. It is possible to provide an injector that has a precisely positioned and shaped spray orifice element on the injector outlet having at least one spray orifice in order to allow for an optimized injection and thus an optimized combustion in an internal combustion engine. This is achieved by an example method in accordance with the present invention that has the following steps:

- providing an injector base element,
- providing a rod that is insertible into a through hole of the injector base element,
- producing a negative matrix of a spray orifice element on an axial end of the rod,
- inserting the rod into the through hole of the injector base element,
- positioning the negative matrix situated on the rod relative to the injector base element,
- producing the spray orifice element having at least one spray orifice by applying a galvanization layer on a downstream end, in the injection direction, of the injector base element and on the negative matrix, and
- removing the rod and the negative matrix.

The injector base element may be essentially tubular, the spray orifice element being designed as a plate-shaped component on the downstream end, in the injection direction, of the injector base element. The injector base element may be provided as a standard part. An adaptation to different internal combustion engines may be achieved by different designs of the spray orifice elements. This allows for a particular favorable and efficient production of injectors for a broad spectrum of use. This allows for a very flexible process, which makes possible a cost-effective and quick and thus efficient production of injectors both in individual parts as well as in great lot sizes.

For producing the spray orifice element, a rod having a negative matrix is provided by way of preparation. For this purpose, the negative matrix is produced on an axial end of the rod, which determines a shape of the spray orifice element having the spray orifice in a later method step. Producing the spray orifice element using a negative matrix makes it possible in a particularly advantageous manner to implement various and complex shapes of the spray orifice element as well as of the spray orifice. In addition, it is possible to vary the spray orifice in a simple manner by varying the negative matrix, while otherwise the method of producing the injector remains the same.

The rod having the negative matrix is subsequently inserted into the injector base element and positioned. The negative matrix is for this purpose situated relative to the downstream end, in the injection direction, of the injector base element in such a way that the spray orifice element may be formed on this end.

The spray orifice element is subsequently produced in that a galvanization layer or a galvanized layer is applied on the downstream end, in the injection direction, of the injector base element and on the negative matrix. For this purpose, an injector assemblage made up of the injector base element and the rod having the negative matrix are immersed in a galvanization bath, as a result of which a thin galvanization layer forms on the end of the injector base element and on the negative matrix. The negative matrix may be designed accordingly such that the galvanization produces a spray orifice element that has the spray orifice. By designing the spray orifice element as a galvanization layer directly on the downstream end of the injector base element, it is possible to implement a precise positioning and form design of the spray orifice element and of the spray orifice.

The spray orifice element has at least one spray orifice, through which fuel may be injected into an induction pipe or directly into a combustion chamber. It is also possible to provide for a plurality of spray orifices in a spray orifice element. The method of the present invention makes it possible to implement several different geometries of spray orifices in one spray orifice element without necessitating additional steps in the production of the injector.

Following the production of the spray orifice element by applying the galvanization layer, the rod and the negative matrix are removed in an additional method step. Rod and negative matrix may be removed jointly. It is also possible to remove the rod first and subsequently to remove the negative matrix separately.

The method of the present invention for producing the injector makes it possible to produce injectors of high quality in a simple and cost-effective manner. It is possible to achieve a high quality particularly with respect to the complex geometrical requirements of the spray orifice elements. The position and shape of the spray orifice element and of the spray orifices developed within it are formed precisely and without elaborate subsequent processing. This yields substantial advantages also in the use of the produced injector in an internal combustion engine. The precise form design and positioning of the spray orifice elements and of the spray orifices make it possible to achieve an optimized injection, which has a positive effect on the combustion in the internal combustion engine, in particular with respect to a particle reduction in the exhaust gases.

Preferred developments of the present invention are described herein.

The negative matrix of the spray orifice element is preferably produced by 3D printing. Particularly preferably, a microscaled 3D printing method is used for the production. A 3D-printed negative matrix allows for a particularly cost-effective and flexible design of the spray orifice element including the spray orifice. 3D printing makes it possible to implement a plurality of different form designs in a simple manner both for small and for large lot sizes. Moreover, a very precise production is made possible with respect to dimension and position of the forms.

It is particularly advantageous if the negative matrix is formed from a photopolymer. This for example allows for further processing and optimization of the produced negative matrix following 3D printing by radiation with light in a suitable wavelength range, for example UV light.

Preferably, the negative matrix is positioned relative to the injector base element by way of a fit and/or a shoulder.

Particularly preferably, the rod has a shoulder for this purpose. It is also possible, however, that the injector base element has a shoulder for positioning. A shoulder makes it possible to position the rod and the negative matrix axially in a simple manner. By way of a fit, in particular a transition fit or an interference fit, it is possible to position the negative matrix radially in a simple and precise manner.

Preferably, prior to galvanization, an electrically conductive layer is applied at least on a subsection of the negative matrix. A silver conductive paint or a graphite spray are particularly suitable for this purpose. In the galvanization process, the galvanization layer is applied only on the subsection covered by the electrically conductive layer. For this purpose, the negative matrix may be coated entirely or only partially by the electrically conductive layer. The galvanization layer is respectively formed on the subsection of the negative matrix, whose surface is electrically conductive. This makes it possible, for example in the case of a negative matrix made from an electrically nonconductive material, to form the spray orifice in a simple manner in that accordingly no electrically conductive layer is applied on a subsection of the negative matrix.

Further preferably, the negative form is formed at least partially from an electrically conductive material. This yields the same design possibilities and advantages as when the electrically conductive layer is applied on the negative matrix. In addition to developing the negative matrix partially from an electrically conductive material, it is also possible to apply an electrically conductive layer on a subsection of the negative matrix. This allows for an even more flexible design of the spray orifice element having the spray orifice.

It is furthermore advantageous if the negative matrix has at least one protruding element. The protruding element is designed to form the spray orifice in the spray orifice element in the galvanization process. For example, the protruding element may be designed as a cylindrical pin and may protrude beyond an outlet plane of the injector base element, on which the spray orifice element is also produced.

At least one subsection of the protruding element is preferably not provided with an electrically conductive layer and/or is not formed from an electrically conductive material. This allows for a particularly simple and precise design of the spray orifice since no galvanization layer is formed on this subsection.

The spray orifice element is particularly preferably made from nickel. Nickel is particularly flexibly replaceable and is compatible with a great number of materials of the injector base element. Nickel additionally offers good corrosion protection.

Furthermore preferably, the negative matrix is removed using a mechanical or thermal or chemical treatment. Depending on the material of the negative matrix and the treatment for removal, it is possible to keep the negative matrix intact and reuse it. This has a particularly favorable effect in terms of low costs and low expenditure of effort in producing the injector. Furthermore, it is also possible to remove the negative matrix by destroying it, for example by smelting.

It is furthermore regarded as particularly advantageous if the method furthermore comprises a step of subsequent processing in order to clear the spray orifice and/or for subsequent shaping. For this purpose, the injector base element and the spray orifice element are preferably processed further by machining.

The present invention furthermore relates to an injector for injecting fuel, which is obtainable by the method of the present invention. The injector is preferably designed to inject fuel into an induction pipe or directly into a combustion chamber of an internal combustion engine.

The present invention furthermore relates to an internal combustion engine having an injector, which is producible by the method of the present invention.

BRIEF DESCRIPTION OF THE DRAWINGS

Below, the present invention is described with reference to an exemplary embodiment in conjunction with the figures. Functionally identical parts are respectively provided with the same reference symbols in the figures.

DETAILED DESCRIPTION OF EXAMPLE EMBODIMENTS

Figure 1:
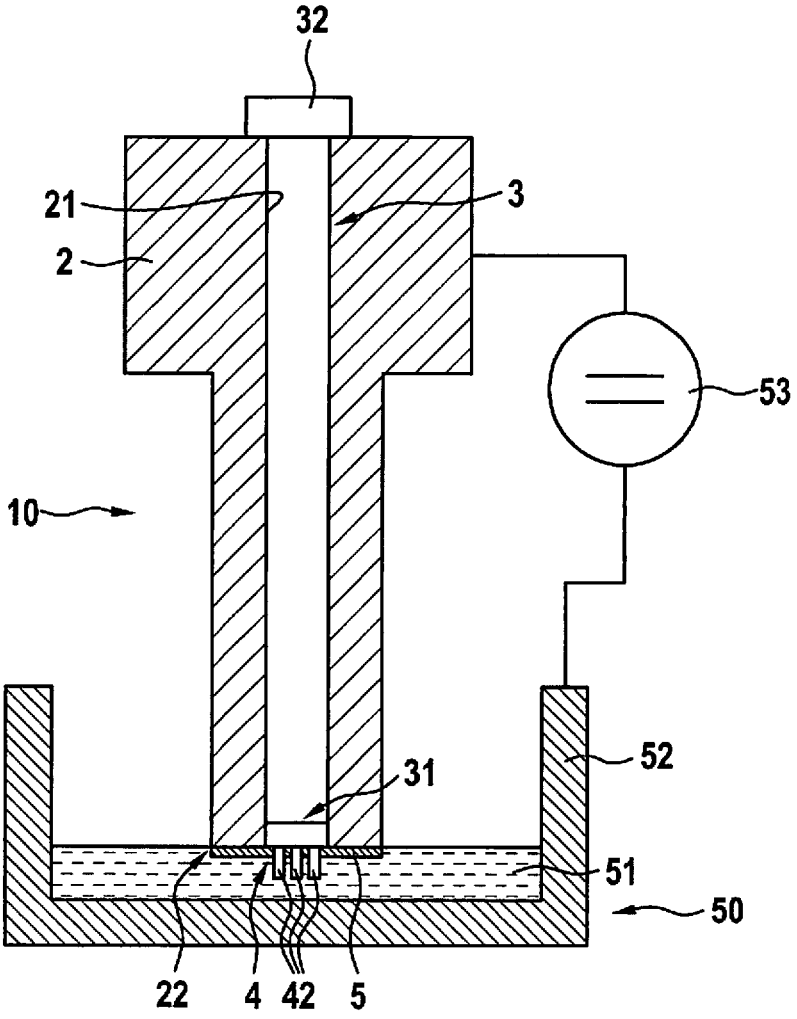
FIG. 1 shows a simplified schematic view of the production of an injector by galvanization in accordance with an exemplary embodiment of the present invention.

FIG. 1 shows a method step of the production of an injector 1, a spray orifice element 5 being produced by galvanization on a downstream end 22, in the injection direction, of an injector base element 2. The method is presented at a point in time at which the spray orifice element 5 is already developed as a galvanization layer, that is, directly prior to the end of the galvanization step.

To produce the spray orifice element 5 from a galvanization layer, an injector assemblage 10 is immersed in a galvanization bath 51 in a vessel 52. Injector assemblage 10 comprises an injector base element 2, a rod 3 and a negative matrix 4 of the spray orifice element 5 that is to be produced. The injector base element 2 is designed as a standard part and may be used as a basis for injectors having different spray orifice elements 5.

Injector base element 2 is respectively shown in the figures as a sectional drawing, the rod 3 and negative matrix 4 being respectively shown in a non-sectional view.

Injector base element 2 has a through hole 21, in which rod 3 is inserted. Negative matrix 4 is situated on an axial end 31 of rod 3, which determines the shape of spray orifice element 5 and spray orifices 6.

For an optimal definition of the geometries of spray orifice element 5, it is necessary to position negative matrix 4 precisely relative to injector base element 2 prior to galvanization. Negative matrix 4 is axially positioned by way of a shoulder 32 on rod 3. If rod 3 is inserted completely into through hole 21 of injector base element 2, shoulder 32 abuts on injector base element 2. In the radial direction, negative matrix 4 is positioned by a fit of rod 3 and of through hole 21 of injector base element 2.

Spray hole element 5 is produced by galvanization. For this purpose, using a voltage source 53, an electrical voltage is applied to injector assemblage 10 and to galvanization bath 51, which is a nickel electrolyte in the exemplary embodiment shown. As a result, a nickel coating is deposited on those regions of the injector assemblage 10 that are immersed into galvanization bath 51 and that have an electrically conductive surface. In the present case, this is the downstream end 22 of injector base element 2 and a subsection of negative matrix 4, which has an electrically conductive surface.

Figure 2:
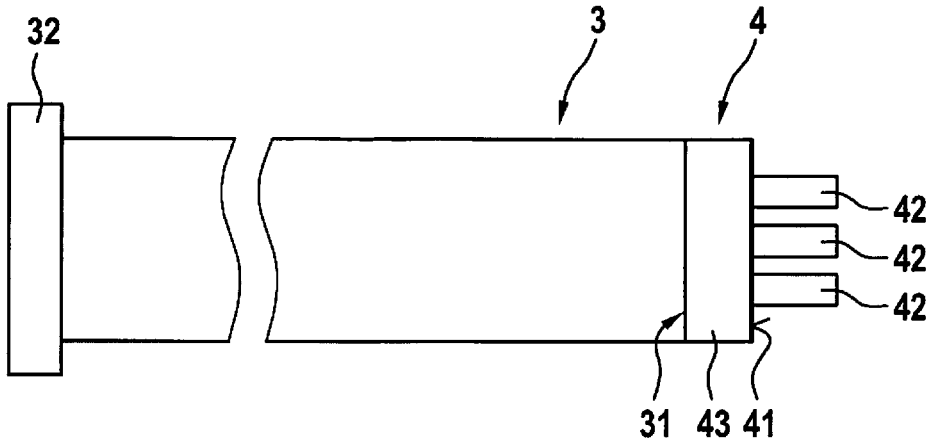
FIG. 2 shows an enlarged schematic view of a rod having a negative matrix.
Figure 3:
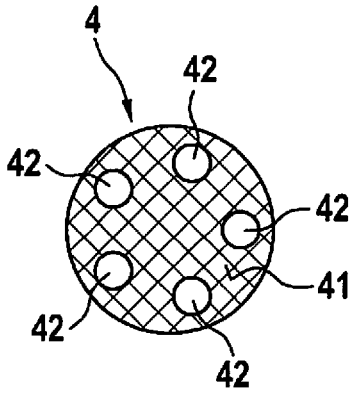
FIG. 3 shows an enlarged schematic view of a negative matrix.

FIGS. 2 and 3 show an enlarged view of rod 3 with negative matrix 4 in two different views, a state being shown prior to the insertion into the injector base element, that is, still without the galvanization layer. Negative matrix 4 is situated on an axial end 31 of the rod. Negative matrix 4 is furthermore formed from a photopolymer and produced by 3D printing. A cylindrical area 43 of negative matrix 4 has the same diameter as rod 3. Negative matrix 4 additionally has protruding elements 42, which form spray orifices 6 in spray orifice element 5. In the exemplary embodiment, negative matrix 4 has five protruding elements 42, as shown in FIG. 3, only three protruding elements 42 or three spray orifices 6 being shown in the schematic views of the further figures for reasons of clarity. Additionally, for better clarity, in the figures, respectively only one of protruding elements 42 or spray orifices 6 is marked with a reference symbol.

Producing negative matrix 4 by 3D printing is particularly advantageous for a favorable and flexible production of injector 1. Thus, it is for example possible to achieve very precise dimensions and the greatest variety of shapes of protruding elements 42 and thus of spray orifices 6. Furthermore, it is a simple matter to produce injectors 1 having different spray orifice elements 5 by merely using different negative matrices 4, the method for producing injector 1 remaining unchanged.

A subsection of negative matrix 4 is provided with an electrically conductive layer 41, in the present exemplary embodiment with a silver conductive paint. As shown in FIG. 2, only one end face of negative matrix 4 facing away from rod 3 is provided with electrically conductive layer 41. Spray orifice element 6 is formed on this electrically conductive layer 41 in the galvanization process shown in FIG. 1. Since the surface of protruding elements 42 is not electrically conductive, no galvanization layer is formed here in the galvanization process.

Figure 4:
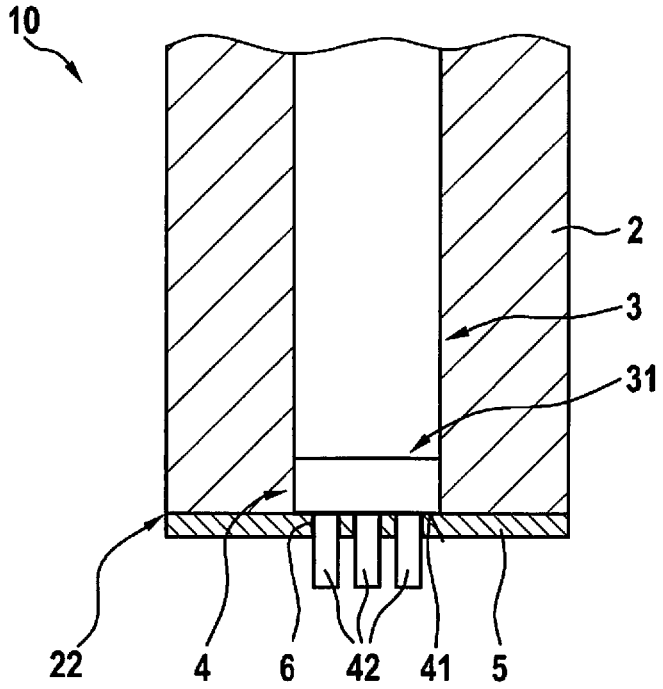
FIG. 4 shows a schematic detailed view of an injector base element together with a spray orifice element following galvanization.

FIG. 4 shows a detail of injector assemblage 10 after galvanization, only a subsection of injector assemblage 10 being shown. The galvanization process forms a thin layer of nickel on the downstream end 22 of injector base element 2 as well as on electrically conductive layer 41 of the negative matrix. This thin plate-shaped nickel layer forms spray orifice element 5. The protruding elements 42 of negative matrix 4 form spray orifices 6 in spray orifice element 5 after their removal.

Following the galvanization process, rod 3 and negative matrix 4 may be removed. Rod 3 and negative matrix 4 may be removed simultaneously or one after the other. The removal is performed with the aid of a mechanical or thermal or chemical treatment.

Figure 5:
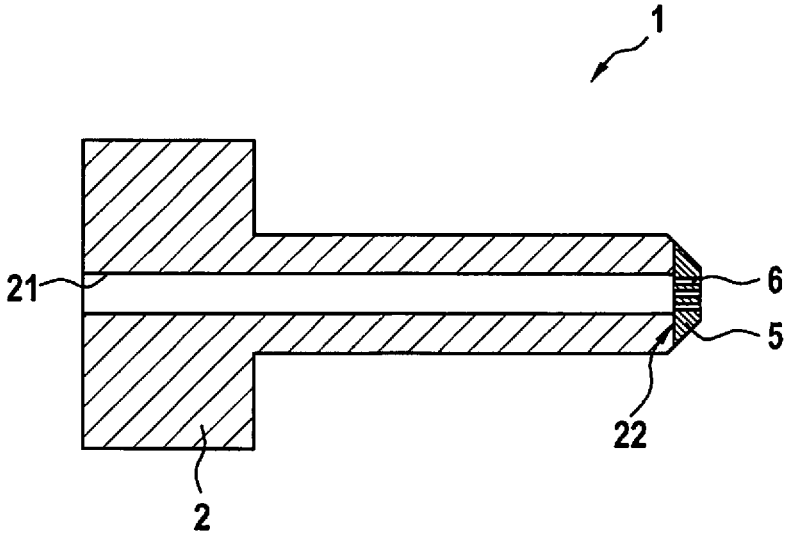
FIG. 5 shows a simplified schematic view of an injector, obtainable by the method according to the present invention.

Subsequently, injector 1 may receive further processing. FIG. 5 shows an injector 1, which is processed further by machining, a bevel being provided on the outer contour of spray orifice element 5. It is furthermore possible to process spray orifices 6 further in order to optimize their geometry further or in order to deburr spray orifices 6.

What is claimed is:

1. A method for producing an injector, which is designed to inject fuel into an induction pipe or directly into a combustion chamber of an internal combustion engine, the method comprising:

providing an injector base element;

providing a rod that is a solid complete form that is slidable, as a whole, into and out of a through hole of the injector base element;

producing a negative matrix of a spray orifice element on an axial end of the rod;

sliding the rod into the through hole of the injector base element;

positioning the negative matrix situated on the rod relative to the injector base element;

producing the spray orifice element having at least one spray orifice by applying a galvanization layer on a downstream end, in an injection direction, of the injector base element and on the negative matrix; and removing the rod and the negative matrix by sliding the rod out of the through hole.

2. The method as recited in claim 1, wherein the negative matrix of the spray orifice element is produced by microscaled 3D printing.

3. The method as recited in claim 1, wherein the negative matrix is formed from a photopolymer.

4. The method as recited in claim 1, wherein the negative matrix is positioned relative to the injector base element by a fit of the rod.

5. The method as recited in claim 1, wherein prior to applying the galvanization layer, an electrically conductive layer is applied at least to a subsection of the negative matrix in order to apply the galvanization layer on the negative matrix and on the injector base element.

6. The method as recited in claim 5, wherein the electrically conductive layer is a silver conductive paint or a graphite conductive spray.

7. The method as recited in claim 1, wherein the negative matrix is formed at least partially from an electrically conductive material.

8. The method as recited in claim 1, wherein the negative matrix has at least one protruding element by which the spray orifice is formed in the spray orifice element.

9. The method as recited in claim 8, wherein at least one subsection of the protruding element is not provided with an electrically conductive layer and/or is not formed from an electrically conductive material.

10. The method as recited in claim 1, wherein the spray orifice element is made of nickel.

11. The method as recited in claim 1, wherein the negative matrix of the spray orifice element is removed by a mechanical or thermal or chemical treatment.

12. The method as recited in claim 1, further comprising:

processing the injector further, the processing further including machining the injector base element and the spray orifice element, following the removal of the negative matrix, in order to clear the spray orifice and/or to shape it further.

13. The method as recited in claim 1, wherein the negative matrix is positioned relative to the injector base element by a shoulder of the rod.

14. The method as recited in claim 1, wherein the inserting of the rod includes shifting a portion of the rod axially within the through hole towards the downstream end of the injector base element, until a shoulder of the rod, which is outside of the through hole abuts against a surface at an upstream end of the injector base element.

15. An injector for injecting fuel into an induction pipe or directly into a combustion chamber of an internal combustion engine, the injector comprising:

an injector base element;

a rod that has been inserted into a through hole of the injector base element and that is slidable out of the through hole;

a spray orifice element; and a negative matrix of a first portion of the spray orifice element on an axial end of the rod;

wherein:

the spray orifice element includes at least one spray orifice, is partly on a downstream end, in an injection direction, of the injector base element, and is partly on the negative matrix; and the rod and the negative matrix are removable by a sliding of the rod out from the through hole, while leaving an entirety of the spray orifice element intact, with the first portion of the spray orifice element spanning across a downstream end of the through hole.

16. A method for producing an injector, the method comprising:

inserting a rod into a through hole of an injector base element, wherein a negative matrix of a spray orifice element is arranged on an axial end of the rod;

producing the spray orifice element having at least one spray orifice by:

applying a layer having an electrically conductive surface such that (1) a first portion of the layer is arranged on a downstream end, in an injection direction, of the injector base element and (2) a second portion of the layer, which is radially interior to the first portion of the layer, is arranged on the negative matrix;

inserting the electrically conductive surface of the applied layer into an electrolyte bath; and controlling a voltage course to apply an electrical voltage to the electrolyte bath, the electrolyte bath thereby forming a metal coating on the electrically conductive surface; and removing the rod and the negative matrix by drawing the rod out of the through hole from an upstream end of the injector base element.

* * * * *